US006223823B1

(12) United States Patent
Head

(10) Patent No.: US 6,223,823 B1
(45) Date of Patent: May 1, 2001

(54) METHOD OF AND APPARATUS FOR INSTALLING CASING IN A WELL

(76) Inventor: Philip Head, 178 Brent Crescent, London, NW10 7XR (GB)

( * ) Notice: Subject to any disclaimer, the term of this patent is extended or adjusted under 35 U.S.C. 154(b) by 0 days.

(21) Appl. No.: 09/323,803

(22) Filed: Jun. 2, 1999

(30) Foreign Application Priority Data

Jun. 4, 1998 (GB) ..... 9812039
Jun. 11, 1998 (GB) ..... 9812490

(51) Int. Cl.[7] ..... E21B 33/13
(52) U.S. Cl. ..... 166/290; 166/386
(58) Field of Search ..... 166/380, 381, 166/382, 242.8, 317, 327, 242.1, 290, 386

(56) References Cited

U.S. PATENT DOCUMENTS 3,910,349 * 10/1975 Brown et al. ..... 166/290 X
4,096,913 * 6/1978 Kenneday et al. ..... 166/290 X
4,364,432 * 12/1982 Bass et al. ..... 166/290
5,197,553 * 3/1993 Leturno ..... 175/57
5,307,886 * 5/1994 Hopper ..... 175/53
5,918,674 * 7/1999 Head ..... 166/348
5,918,677 * 7/1999 Head ..... 166/380

* cited by examiner

*Primary Examiner*—David Bagnell
*Assistant Examiner*—Kamal Dawelbeit
(74) *Attorney, Agent, or Firm*—Herbert Dubno

(57) ABSTRACT

A method of installing a casing section in a well, by means of first and second connection devices arranged on a tubular lowering device, the first connection device being connected at an upper end of the casing section and the second connection device being connected at a lower end of the casing section, the tubular lowering device extending through the casing section. First and second flow paths are provided to enable fluids from the well to pass through the inside of the casing, as the casing is lowered into the well. A hollow is provided through the second connection device connecting the inside of the tubular lowering device to the outside of the casing. A lockable nonreturn valve is provided in the hollow which permits the well fluids to flow form inside the internal bore of the tubular lowering device to the well outside the section being installed, and also permitting fluids to flow form the well to the inside of the tubular lowering device and thus back to surface. When the casing to be fitted has been lowered to its installed position, the lockable return valve is unlocked, thus operating as a conventional nonreturn valve and preventing the unwanted flow of fluids up the internal bore of the section being installed.

13 Claims, 10 Drawing Sheets

METHOD OF AND APPARATUS FOR INSTALLING CASING IN A WELL

SPECIFICATION

1. Field of the Invention

The invention relates to a method of installing the casing in a well land an apparatus therefor. Casings are required in wells in order to separate the well from the surrounding formations. Typically the casing is provided in sections which are lowered into the well following the drilling of each corresponding section of the well.

2. Background of the Invention

For the casing of a well, each casing section could be installed inside the previously installed section and consequently its external diameter has to be less than the internal diameter of the installed section. Furthermore it was necessary that an annular gap between the internal diameter of the installed section and the external diameter of the next section be sufficient to accommodate the connecting means between the two sections which includes hanging and packing means as well as the additional diameter of the joints between each length of tubing making up each section. The annular gaps between each subsequent casing section determine the size of the first casing section which is required to be sufficiently large to enable all the required subsequent casing sections to be passed through it and installed in the well. The final casing section is of sufficient diameter to carry out all the desired functions in the production zone of the well, which may require over 5 different lengths of casing sections. This results in the first casing section being very large in diameter and therefore expensive and requiring a large diameter hole to be drilled out in order to accommodate it. Furthermore it may be necessary due to the large diameter of the upper sections to extend the smaller diameter lower sections all the away to the surface in order that the required pressure resistance is provided.

OBJECT OF THE INVENTION

The object of the invention therefore is to reduce the required diameter of the sections to considerably reduce the overall costs of the well both in terms of the drilling itself and disposable of the drilled material and in terms of the costs of the large diameter sections.

It has been proposed previously to provide lower diameter sections by reducing the annular space as much as possible, for example in U.S. Pat. No. 5,307,886. The result is a narrow annulus and with the method of installation disclosed in this patent and used conventionally the problem is that the well fluids displaced by the introduction and lowering of the subsequent casing section into the well have to pass up the annular space to exit the well at the surface. This presents considerable disadvantages due to the very high friction pressure which must, be overcome in order for the well fluids to pass up the narrow annular space. Consequently even with high hydrostatic pressures the installation is very slow due to the time taken for the fluids to pass up the annular space. Additionally the circulation of cement is very problematic because it relies on the displacement of the mud fluids in the well. It is difficult to effectively displace all of the mud which causes incomplete cementing.

SUMMARY OF THE INVENTION

According to the invention there is provided a method of installing a casing section in a well, wherein the casing section to be installed is lowered into the well by means of first and second connection means arranged on a tubular lowering means, the first connection means being connected at an upper end of the casing section and the second connection means being connected at a lower end of the casing section, with tubular means extending through the casing section.

Preferably first and second flow paths are provided in each of the first and second connection means to enable fluids from the well to pass through the inside of the casing, as the casing is lowered into the well.

The first and second flow paths may be ports controlled by valves which are held in the in the open position, during the lowering of the casing.

Preferably the first and second connection means are connected by the tubular lowering means which extends through the first connection means to the second connection means. A hollow is provided through the second tool part connecting the inside of the tubular lowering means to the outside of the casing.

Preferably a lockable non return valve is provided in the hollow which when in the locked open position permits the well fluids to flow from inside the internal bore of the tubular lowering means to the well outside the section being installed, and also permitting fluids to flow from the well to the inside of the tubular lowering means and thus back to surface. When the casing to be fitted has been lowered to its installed position the lockable return valve is unlocked thus operating as a conventional non return valve and preventing the unwanted flow of fluids up the internal bore of the section being installed.

This may be done by pressurizing an activating ball, which is of such dimensions that it releases a catch device, which had been holding the non-return safety valve in the open position.

The casing sealing cement is then pumped down through the internal bore of the lowering means through the lowering tool and down through the internal bore of the casing section being installed, out through the bottom end thereof through the open non-return valve and back up to fill the annular space between the casing section being installed and the drilled well.

The well fluids are displaced upwards through the gap between the casing being installed and the existing casing, into the annular space between the tubular lowering means and the existing casing section.

DETAILED DESCRIPTION OF THE PREFERRED EMBODIMENTS

Figure 1:
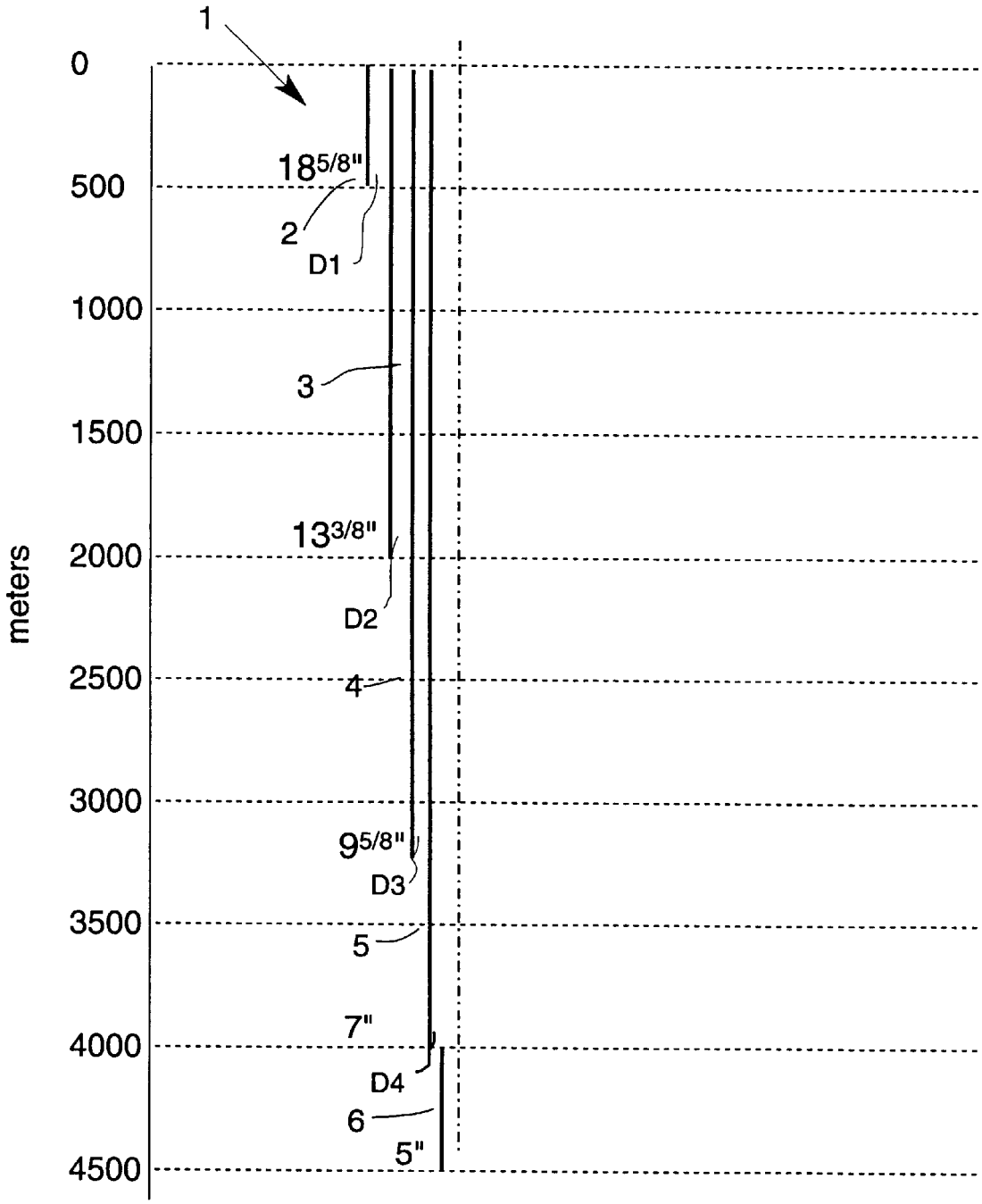
FIG.1 (PRIOR ART)
FIG. 1 is a diagrammatic front elevation of a well casing of the prior art.

Referring to the FIG. 1 it can be seen that conventionally a well casing comprises a very wide diameter section at the surface, which gradually reduces, with each subsequent section as the well progresses downwards. This particular well shown is 4500 meters deep. The uppermost casing section 2 is typically 18.875 inches (47.94 cm) in diameter although in some wells this uppermost casing section is as large as 30 inches (76.2 cm). A second casing section 3 extends inside the uppermost casing section 2 from the surface and is 13.375 inches (33.97 cm) in diameter with an annular gap D1 between it and the internal diameter of the first casing section 2. Subsequently a third casing section 4 of approximately 9.625 inches (24.45 cm) is inserted inside the second casing section 3 and extends from the surface with an annular gap D2 from the second casing section 3. A fourth casing section 5 is then inserted from the surface having a diameter of 7 inches (17.78 cm) with an annular gap D4 from the third casing section. Finally a fifth casing section 6 of 5 inches diameter (12.7 cm) is installed being suspended from the previous casing section 5 and leaving an annular gap D4 therewith.

In this conventional casing, each casing section is lowered at a sufficient speed to permit an adequately fast construction time for the well because the well fluids can be displaced from the lower parts of the well through the annular gaps D1, D2, D3, D4 to the top of the well as the casing sections are lowered into the well. However the required width of the well requiring the use of expensive large diameter casing tubing and also in the removal of considerable amounts of cut rock which has to be disposed of.

Figure 2:
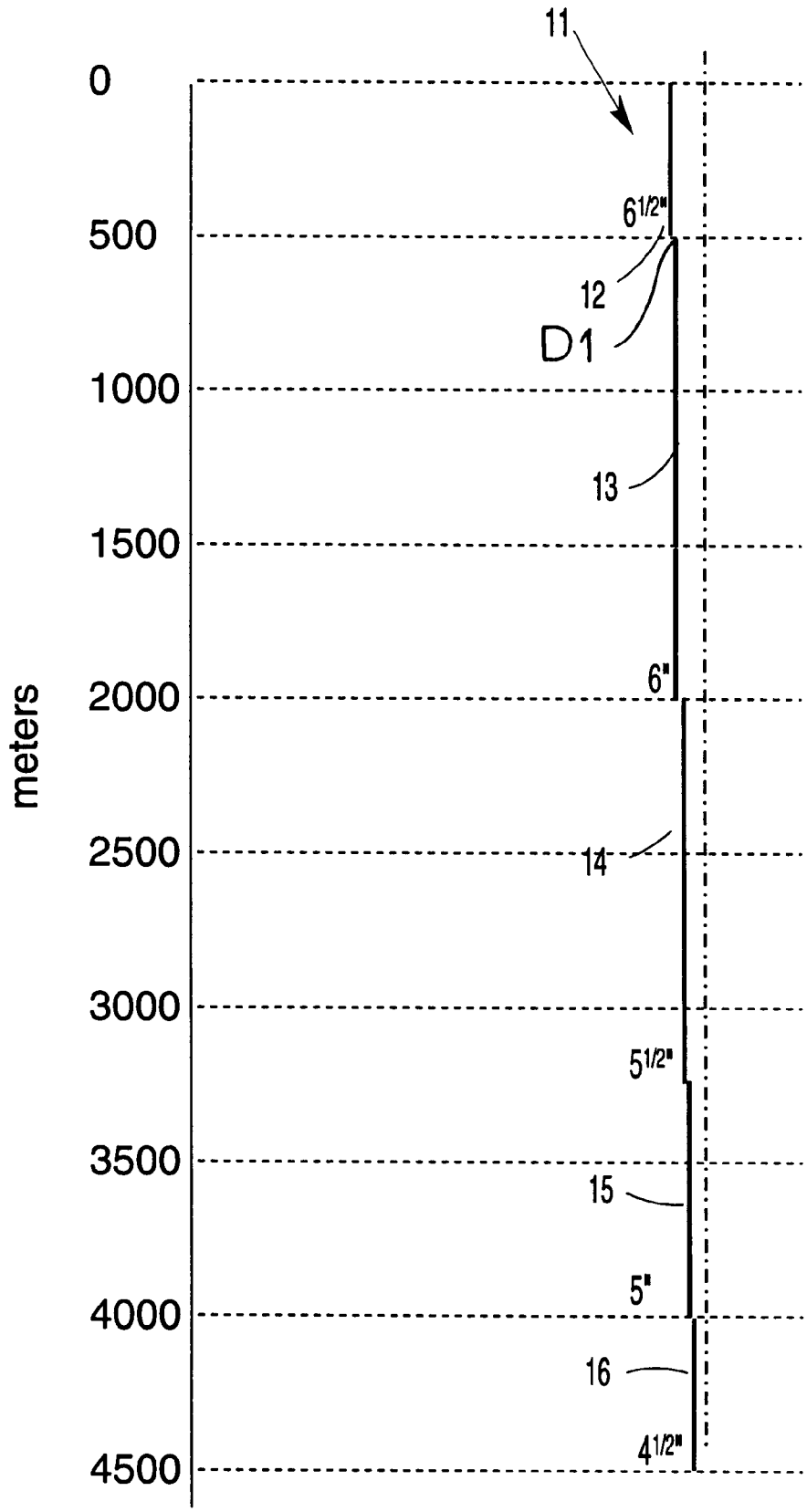
FIG. 2 is a front elevation of the well casing according to the invention.

FIG. 2 requiring according to the invention that has a first casing section 12 having a diameter of 6.625 inches (16.83 cm). A second casing section 13 has a diameter of 6 inches (15.24 cm) and is installed in and suspended from the is installed and hung off the lower end of the first casing section 12 which results in a small annular gap D1. The subsequent sections 14, 15, 16 are 5.375, 4.75 and 4.125 inches in diameter respectively and each is hung off the lower end of the previously installed section and cemented in the usual way. This results in much smaller annular gap which also has the consequence that considerably less material has to be drilled out of the well and disposed of and casing sections of considerably smaller diameters can be used. This dramatically lowers the cost of the well.

Figure 3:
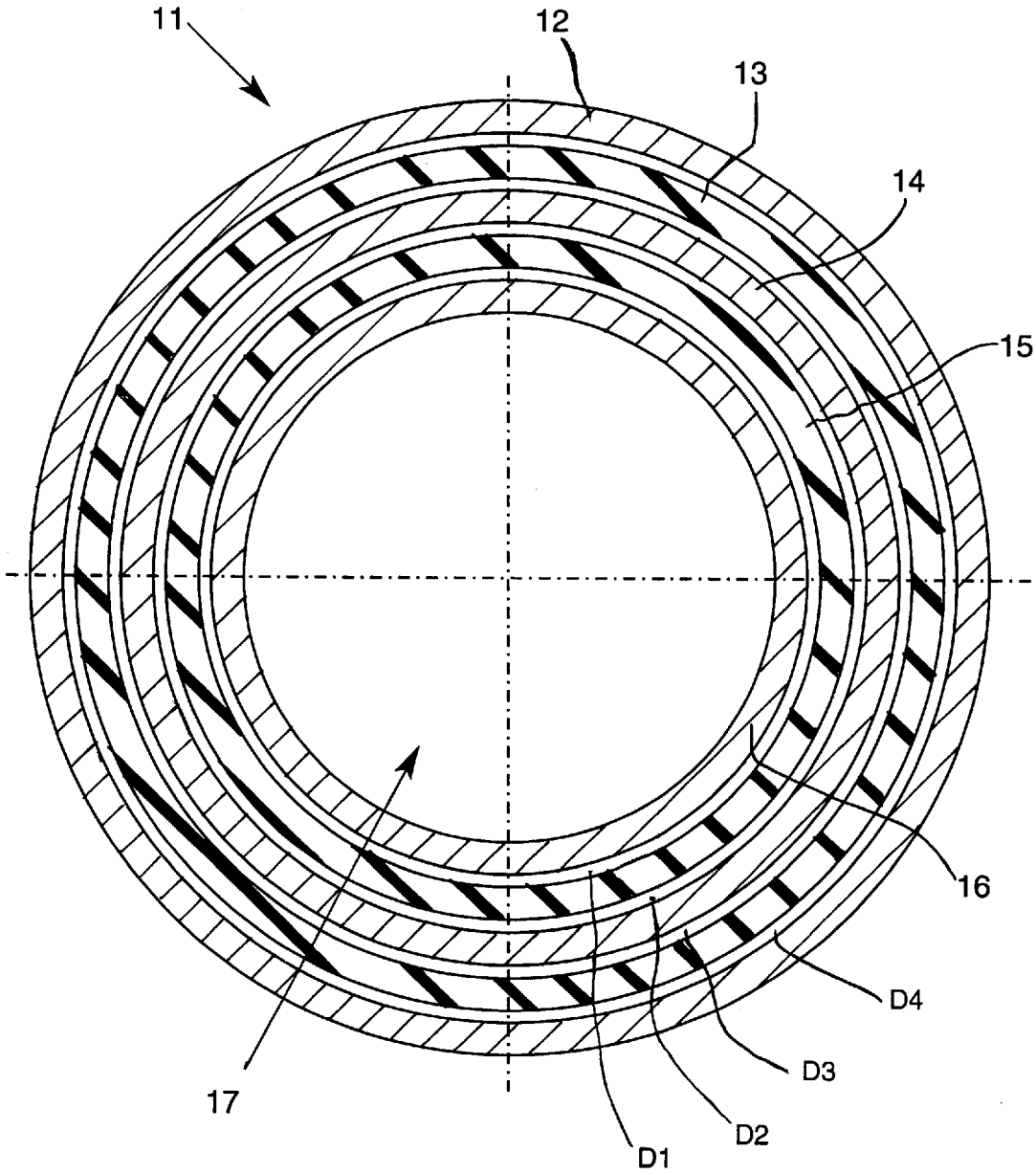
FIG. 3 is a cross section through the casing of the well of the invention viewed.

FIG. 3 shows casing 11 as compromising the casing sections 12, 13, 14, 15, 16 according to the invention in cross section and also the small annular gaps D1, D2, D3, D4 between the casing sections, as well as the bore 17 through the well casing.

The invention provides a method of installing the casing sections 12, 13, 14, 15, 16 with small annular gaps there between and which permits the casing sections 12, 13, 14, 15, 16 to be installed in a speedy way which does not cause increases in the construction time of the well.

Figure 4:
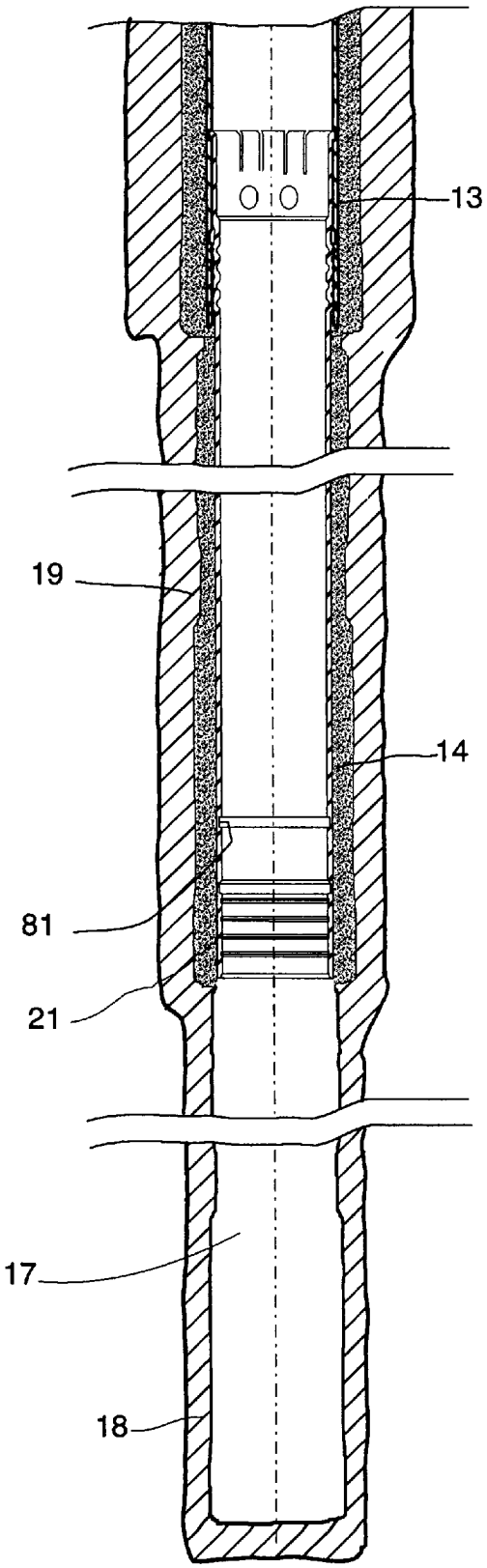
FIG. 4 is a longitudinal section of a well comprising the casing according to the invention showing a drilled out portion of the well.

In FIG. 4 a well is shown by way of example with casing sections 13 and 14 already installed and cemented in by cement 19. The well hole is further drilled out below the last casing section 14 and to a greater diameter then the last casing section to form a new drilled section 17 in the new rock 18. This over diameter reaming drilling can be carried out using known drilling techniques. It will be appreciated that the invention can be applied to any well that is drilled by any known technique. A groove is shown at 81 at the coupling end 21 of casing section 14.

Figure 5:
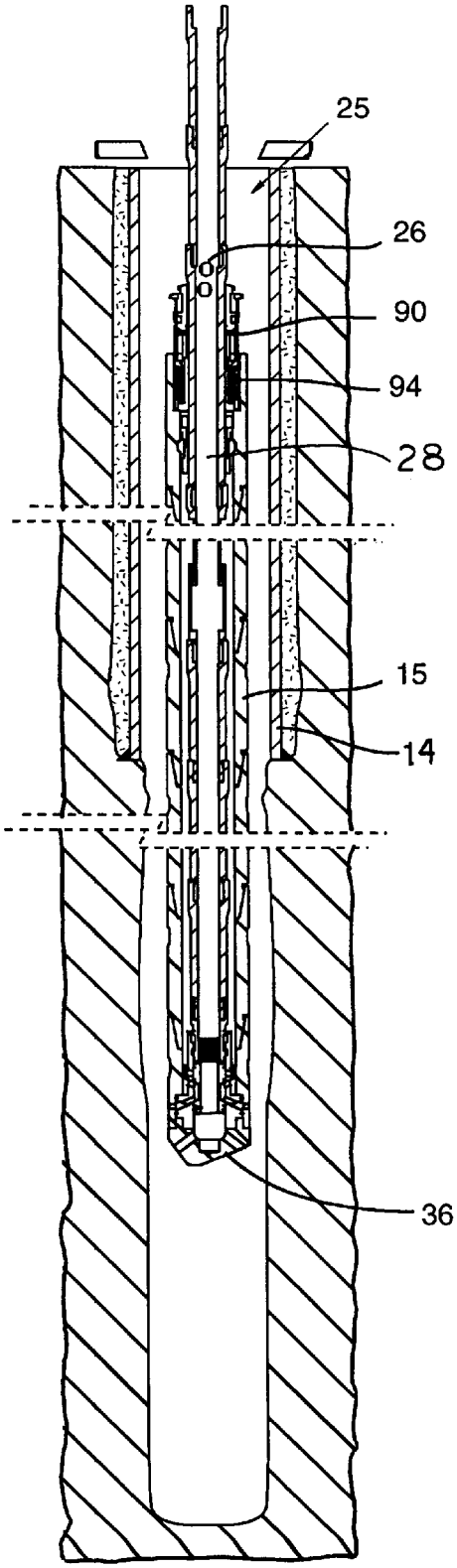
FIG. 5 is a longitudinal section of a well comprising the casing and apparatus according to the invention showing a first step of the method of casing installation according to the invention.

As can be seen from FIG. 5 the section 15 to be installed is lowered into the well. The gap between the existing casing 14 and the new casing 15 is exaggerated to show the details more clearly, but in reality this gap would be much smaller than in conventional casing procedures as a consequence of the invention. In the embodiment shown in FIG. 5 the casing section 15 and the supporting tube 26 is provided by a length of joined tubing. The casing section 15 and the supporting tube 26 are alternatively and preferably provided by a suitable length of continuous coiled tubing which would be installed in the well from a reel. In FIG. 5 the casing section 15 is held in the position shown with the upper most part of the casing section 15 just below the top of the well. An upper part 90 of a tool (described below) is also seen in FIG. 5.

The lower end of the casing section 15 comprises a lockable non-return valve 36 which normally permits flow downwardly out of the lower end of the casing section 15 but prevents flow upwardly into the casing 15 but which may be optionally held in the open position to allow the well fluids to pass up the inside of the casing section 15. The lowering tool 25 comprises gripping seals 94 which grip the casing section 15 as it is lowered into the well. The lowering tool 25 has an internal bore 28 which permits the displaced well fluids to pass up through the lowering tool 25 and out through the coiled tubing 26 to be filtered and re-used or disposed of in the usual way. Similarly fluids may be pumped down the bore 28 of the tubing 26 to carry out the installation procedure which will be described in detail below.

FIG. 5, shows that as the casing section 15 is lowered further into the well the displaced fluids can pass up the internal bore of the lowering tool 25, and through the annulus between the lowering tool 25 and existing casing sections 12, 13, 14 through side valves provided in the lowering tool 25. Alternatively positive pressure may be applied to the coiled tubing 26 to ensure that all the displaced fluids are displaced into the main well casing 12 and dealt with by the usual mud handling facilities at the surface of the well. It is easier to dispose of the well fluids if they are displaced through the annulus and also the working platform and the coiled tubing reel is not exposed to the production reservoir which may be subject to uncertain reservoir pressures. These are best dealt with in the conventional way by allowing the well fluids to be displaced through the annulus between the coiled tubing lowering means 26 and the existing casing 12, 13, 14 as the new length of casing 15 is lowered into the well.

Figure 7:
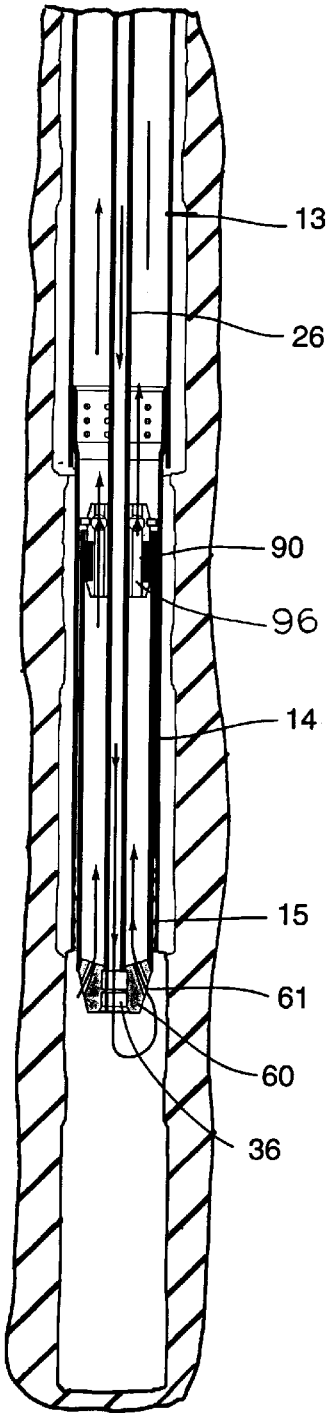
FIG. 7 is a longitudinal section of the casing being installed subsequent to the step of FIG. 5.
Figure 8:
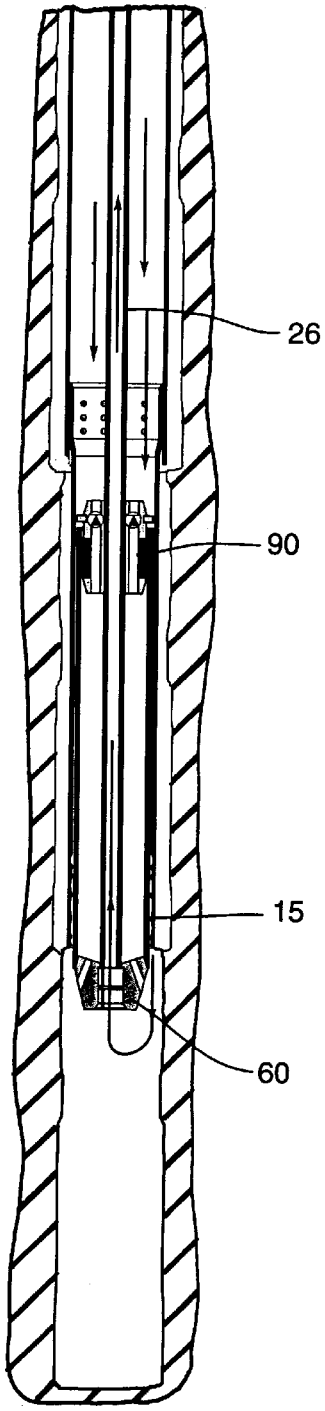
FIG. 8 is the same as FIG. 7 showing a further circulation path.
Figure 9:
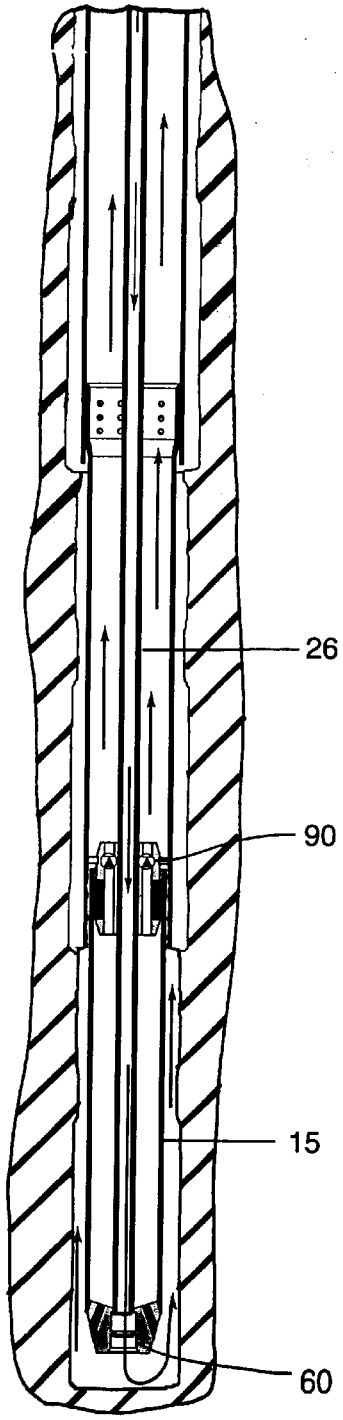
FIG. 9 is the same as FIG. 7 showing the casing in the installed position.

Referring now to FIGS. 7 to 9, FIGS. 7 and 9 show a specific embodiment of the lowering method. Firstly referring to FIG. 7, the casing section 15 to be fitted is lowered to its lower required position and to passes through the last previously positioned casing 14 which results in severe restriction to the fluid flow. The fluid is permitted to flow into the casing section 15 is being fitted by means of open pathways 61 arranged in the shoe 60 at the lower end of the casing section 15 is being fitted. The fluid flows out of the casing section 15 is being fitted at its upper end through path ways 96 arranged at the upper end of the casing 15. When the lower end of the casing 15 reaches the open hole as shown in FIG. 7 it may be necessary to increase the flow rate to assist in the clean up of the hole. Flushing fluid is pumped down the center of the tubing 26 and passes back up through the pathways 61 and 96 as shown by the arrows in FIGS. 7 and 12. The upper lowering tool part 90 is also visible in these Figures. This pumping may continue as the casing section is lowered into the open part of the hole to ensure that the hole is clear of debris and that the debris does not clog up the valves and pathways in the installing tool parts 60, 90.

Additionally or alternatively it may also be desirable and is possible by means of the invention to reverse circulate to assist in the passage of the casing and this is shown in FIG. 8. Fluid is pumped down the annulus and circulated up the installing tool tubing 26 back to surface as shown by the arrows in FIG. 8 and 11. The check valve 97 in the upper lowering tool part 90 only permits flow upwardly from inside the casing section 15, so that when fluid is pumped down the existing casing it is forced down the annular gap between the casing section 15 being fitted and the existing casing and then the flow goes back up the installing tool tubing 26.

By means of one or both of the circulation method of FIGS. 7 and 8 the lower end of the casing section 15 being fitted, the installing tool shoe 60, valve 36 and pathways 61 are kept clear of any debris in the drilled hole which may cause blockages.

Figures 10, 11, 12, 13:
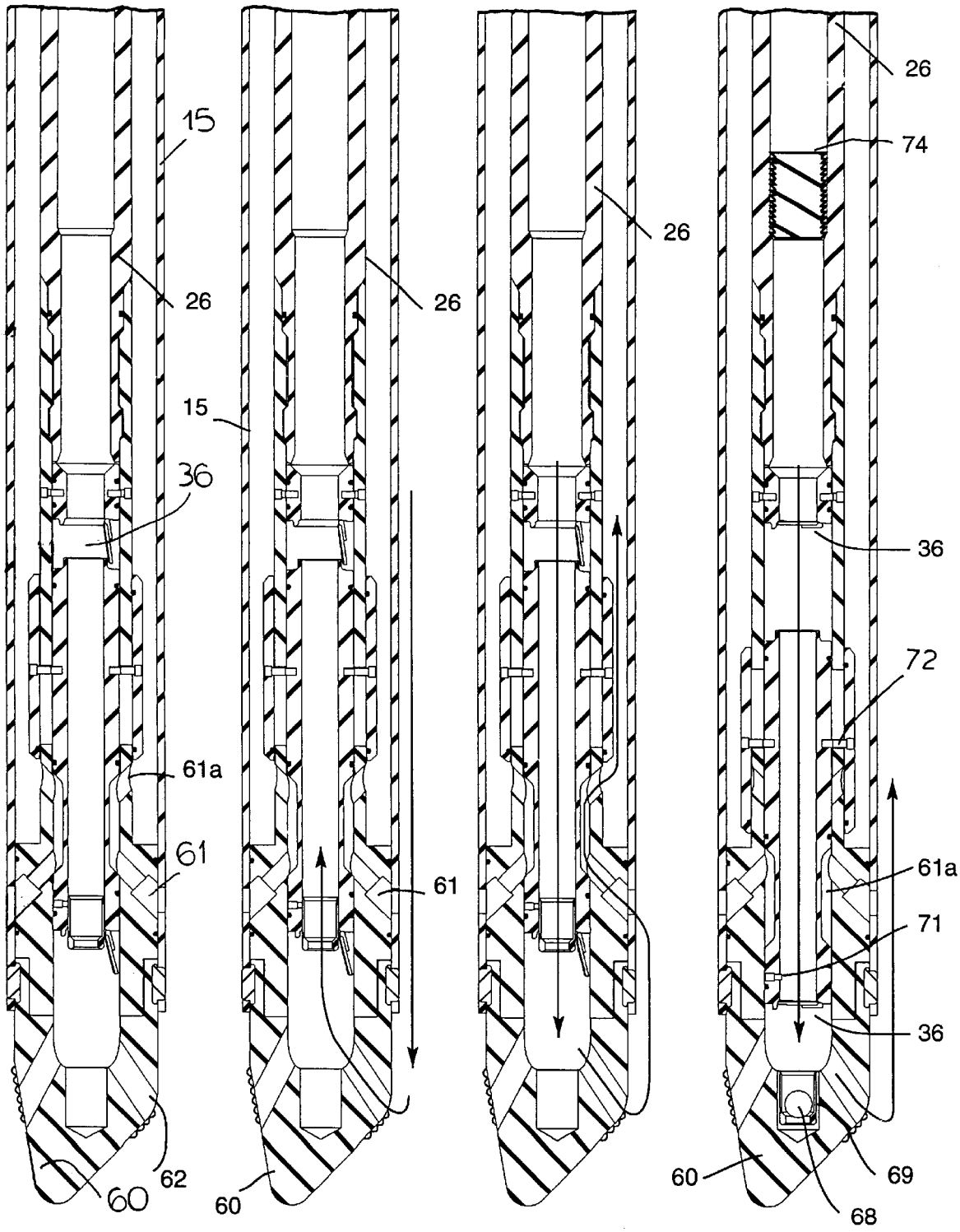
FIG. 10 is an enlarged longitudinal section of the lower end of the casing being fitted of FIG. 7.
FIG. 11 is the same as FIG. 10 showing a further circulation path.
FIG. 12 is the same as FIG. 10 with the casing in the installed position.
FIG. 13 is the same as FIG. 12 with the lower end of the casing sealed off.

From FIGS. 9 and 13 it can be seen that when the installing tool is at the correct setting depth there is a weight indication at the surface by means of weight sensing means. The circulation is then stopped and the lockable non return valves 36 are activated by lowering a ball down through the lowering means 25 under pressure. There are many other ways of remotely activating the lockable non return valve, which will be apparent to the person skilled in the art. The ball is seen at 68 in FIG. 13.

The tubing 26 is then pressurized to close all other circulation paths and in particular the pathways 61, and activate the nonreturn valves in the shoe 60. "Bottom up" circulation can now be performed in readiness for the cementing operation. The check valve 97 above the connection of the tool casing section 15 ensures that there is no flow back into the casing 15. The circulated fluid passes down the tubing 26, and through the remaining annular gap between the existing casing and the casing being fitted 15 across the length of the overlap of the existing casing and the casing being fitted 15. The pressure drop across this overlap is preferably of the order of 300 psi (20 bar), although other pressures may be effective.

FIGS. 10 to 13 show the same circulation procedures as described with reference to FIGS. 7 to 9 and are enlarged views of the lower part to show a more detailed specific embodiment of flow paths and valves. The non return valves 36 are locked open to permit circulation back inside the casing 15 as shown in FIG. 10. Fluid is pumped down through the running in tubing 26 out through the exit port 62 in the casing shoe 60 and back in through path ways 61 in the shoe 60 and back into the inside of the casing 15. Reverse circulation is shown in FIG. 11 where fluid is pumped down the existing casing and is constrained to flow in the annulus between the casing being fitted and the existing casing and passes up through the exit port 62. The pathways 61 are effectively closed in this set up by the check valves 97 (FIG. 14), which are closed by the pressure of the fluid in the existing casing, to constrain the fluid passing up the running-in tubing 26.

Referring to FIG. 12, when the casing 15 is in position, the non return valves 36 are activated by the ball 68 (FIG. 15) which is passed through under pressure releasing the non return valves 36 by engaging against a housing 69 arranged in a central channel. The ball 68 also causes a blocking collar 71 to seal the pathways 61 and 61*a*, which effectively seals off access to the inside of the casing 15. Detents 72 locate the blocking collar 71 in the closed position. Bottom up circulation can then take place to cement the casing 15 in position. Cement is pumped down through the installing tool tubing 26 and pushes the fluids in front of it downwards out through the exit port 62 and back up the outside of the casing 15. When the cementing operation is complete a wiper 74 (FIG. 13) is passed down the lowering tube 26 under pressure to wipe any remaining cement that may have adhered to the inside wall of the tube 26. In this embodiment the wiper 74 (FIG. 13) also serves as a seal to block and seal the hollow end 62 of the tube 26 for the subsequent pressurizing to fix and seal the casing.

It will be appreciated that the sealing operation can be carried out by any suitable convenient means such as a separate sealing member being passed down under pressure or by activation of sealing member already located within the lower tool part 60.

Figure 6:
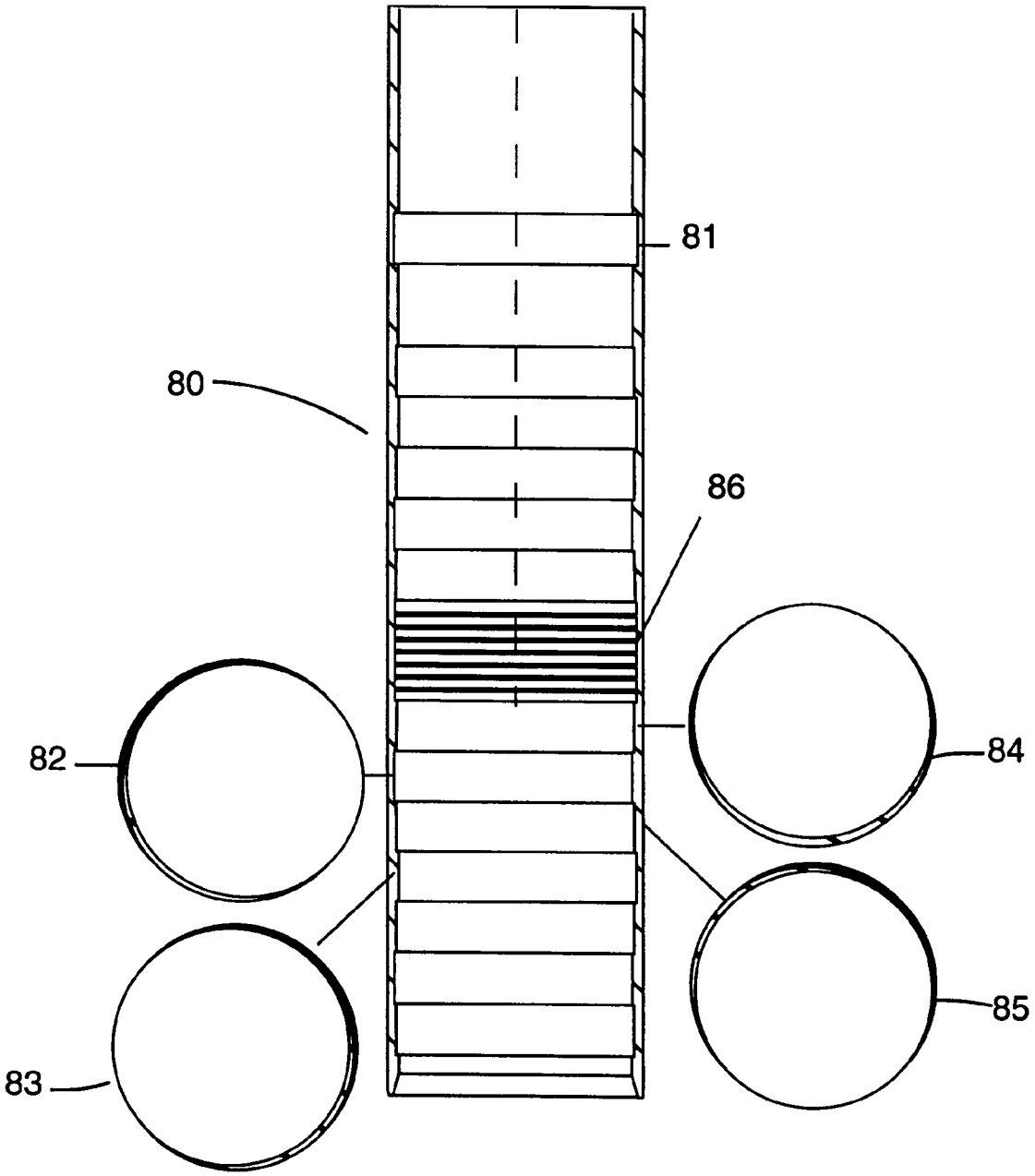
FIG. 6 is a longitudinal section of the lower end of a casing section of the invention.

FIG. 6 diagrammically shows the internal profile of the lower end of the casing in which the casing shoe 60 is located and which also forms the hanging support for the subsequent casing section. The shoe has been drilled away to expose the machined internal wall of the casing which is ready for the subsequent casing to be located and secured. The hanging support comprises a series of undercuts which form the hanging profile 80 for a subsequent casing. The hanging profile comprises a locating profile or groove 81, which provides surface feedback when the running tool assembly reaches it. Eccentric undercuts 82 to 85 are provided in the profile to provide both tensile and torsion restraint. The profile 80 also includes concentric knife edges 86 to provide a pressure seal.

Figure 14:
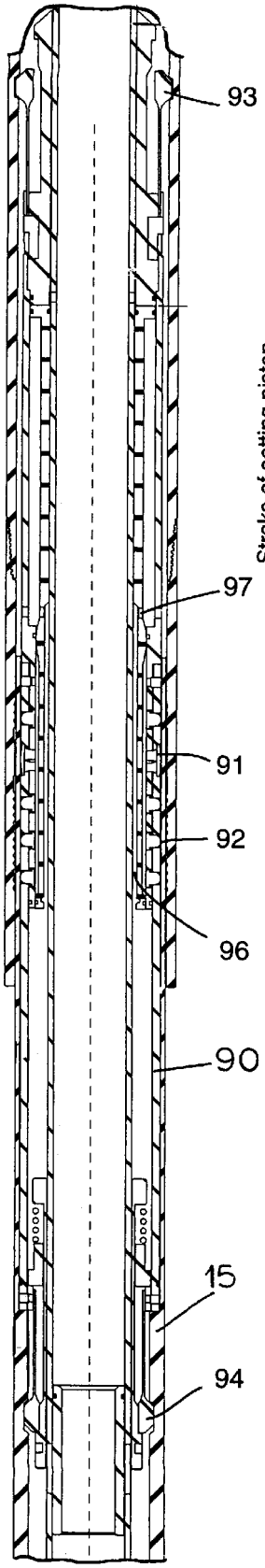
FIG. 14 is an enlarged cross section of the upper part of the casing being fitted, FIG. 15 the same as FIG. 14 showing a subsequent step, FIG. 16 the same as FIG. 15 showing a subsequent step.
Figure 15:
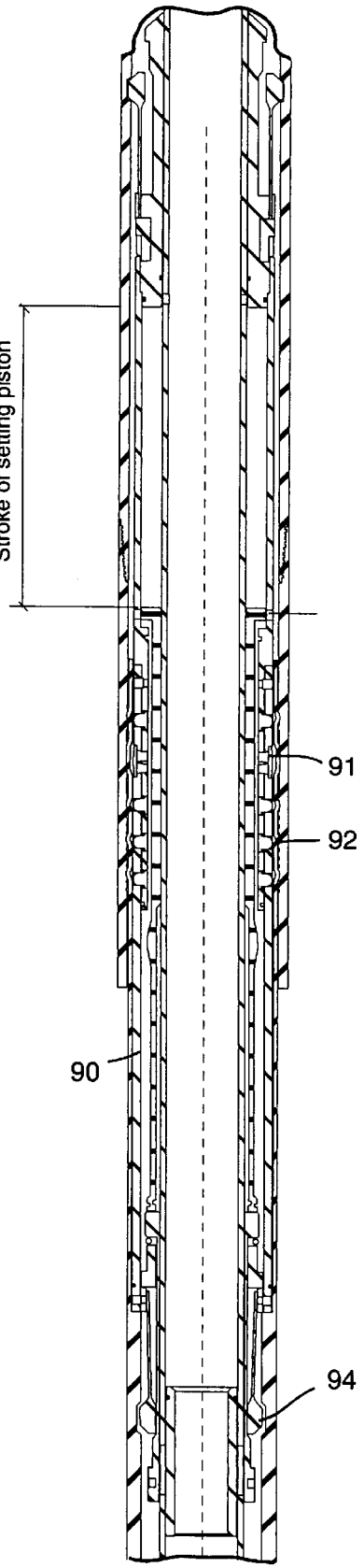

Referring now to FIGS. 14 and 15 a more detailed FIGS. 14 and 15 show in greater detail an embodiment of an upper part 90 of the installing tool is shown which is arranged at the upper end of the casing 15 being conveyed into the well and provides flow paths 96 for the various circulation modes and also sets and seals the casing 15 once the cementing operation has been completed. The upper part 90 includes a swage expanding mechanism 91 which provides a high pressure seal between the new casing 15 and the existing casing when the cementing process has been completed. The upper part 90 of the installing tool also comprises dimple formers 92 which correspond with the eccentric undercuts of the hanger profile of the existing casing to mechanically locate and fix the casing being installed in the required position on the existing casing. A simple locating means 93 is provided which co-operates with the corresponding locating profile 81 in the existing casing to accurately locate the upper tool part 90 in the existing casing. Projections at the lower end of the tools are shown at 94.

The mechanical dimpled formers 92 and the pressure seal 91 are activated by means of internal pressure applied by means of pressurized fluid introduced in the lower tubing means 26.

Figure 16:
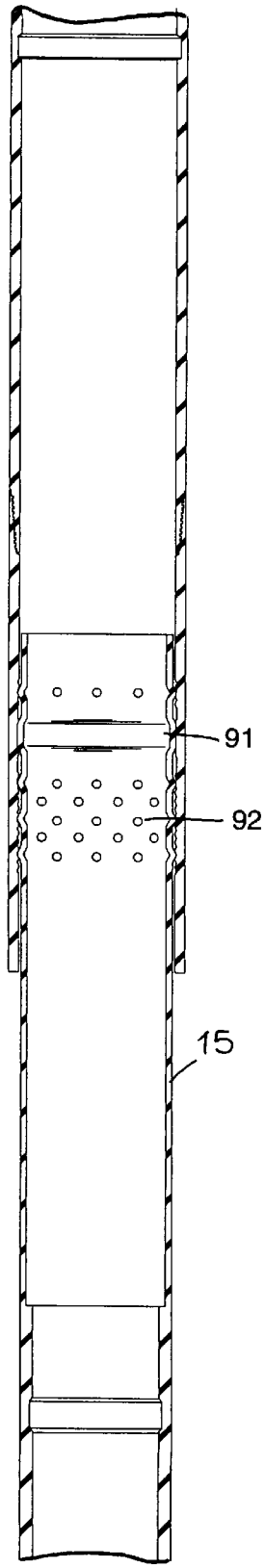
Figure 17:
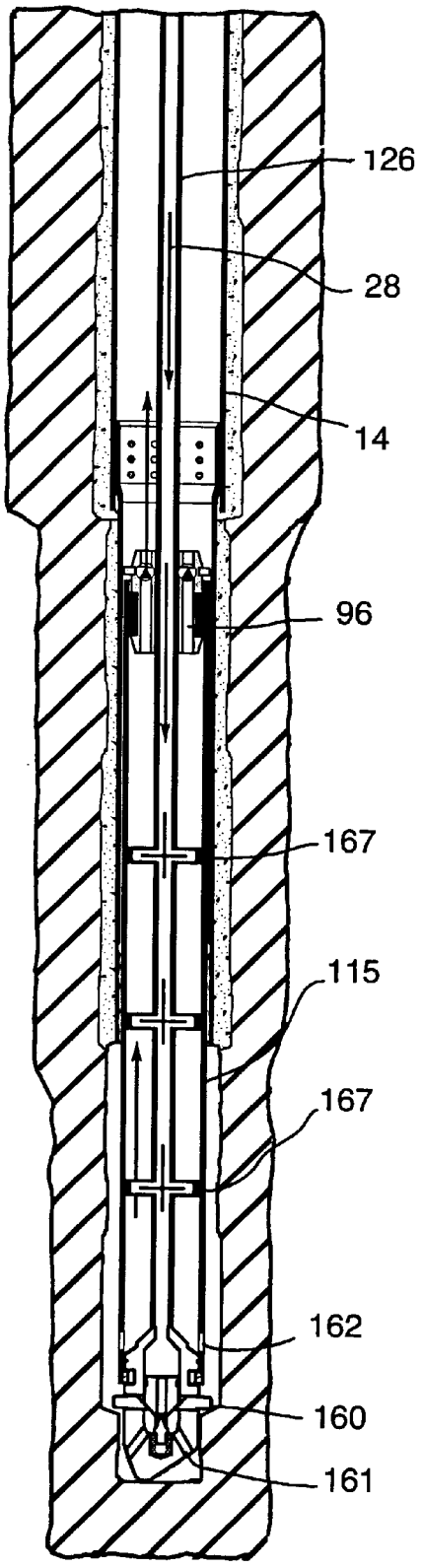
FIGS. 17–21 are sectional views illustrating a well drilling operation.
Figure 18:
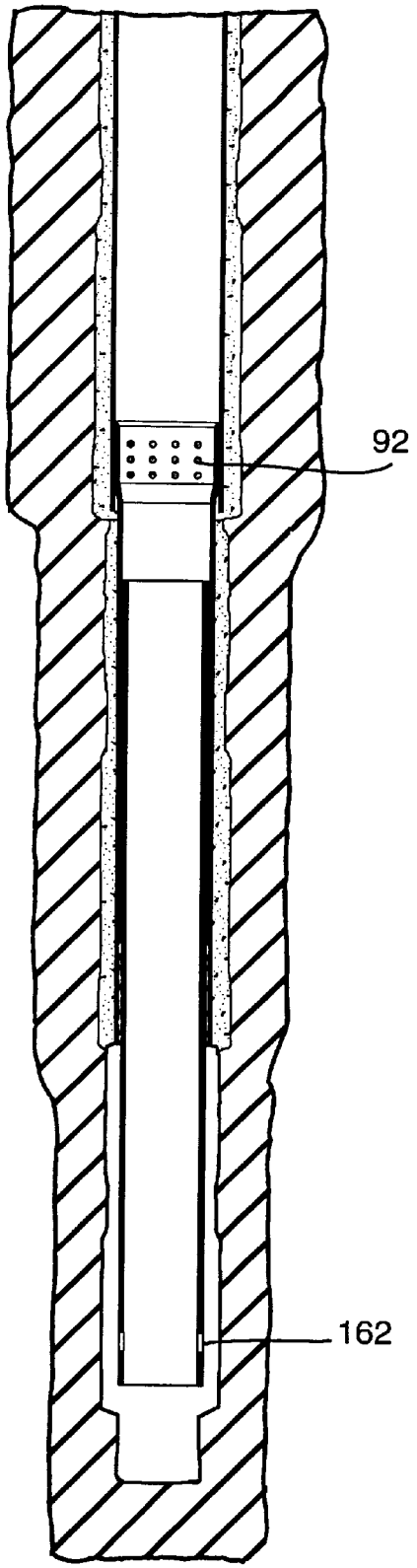

FIG. 16 shows the casing 15 located and sealed in its desired position and the running tool 25 has been released and retrieved to surface by means of the running-in tubing 26. The mechanism 91 and the dimple formers 92 are shown in FIG. 16 as well.

The section being fitted could also be a sand screen as well as a casing section such sand screen being necessary to protect the well from areas of formation which generate sand as well as the desired hydrocarbons.

The section being fitted could also be a mono-bore liner or completion barrier. Such a completion barrier will be installed when all the casing section required are installed and the drilling of the well is complete.

In the embodiments described above the well hole has been pre-drilled to the depth of a pre-determined length of casing and the casing is subsequently lowered into the pre-drilled hole. In a further embodiment of the invention shown in FIGS. 17 to 21 the shoe 60 is replaced by a drill bit arrangement 160 arranged at the lower end of the casing. The drill could be either an electrically powered drill of a pressurised fluid drill. The rotating drill removes material from the lower end of the well and this material is cleared away by pressurised fluid (usually drilling mud) passing down through the bore 28 of the lowering tube 126 and out through passages 161 in the drill head and back into the annular space between the tube 26 and the casing 15 via ports 162 at the lower end of the casing.

Percussion impact means 166 are provided along the tubular lowering means which provide additional downwards force to the drill and are supported by the casing being lowered and permit fluid to flow through the annulus. The percussion impact means 166 are preferably driven by fluid pumped into the tube 126.

Figure 19:
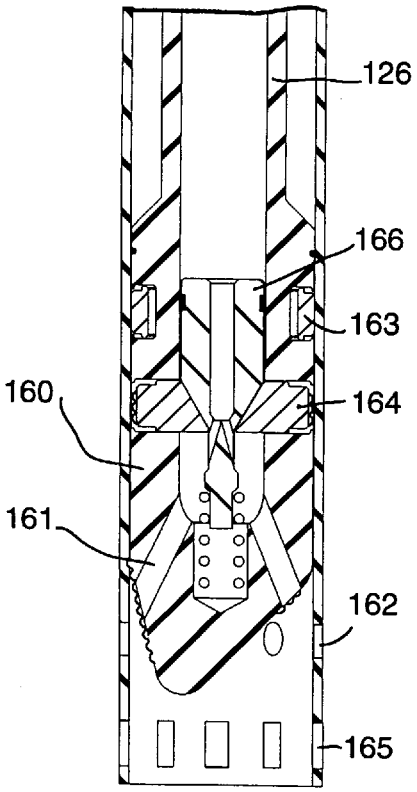
Figure 20:
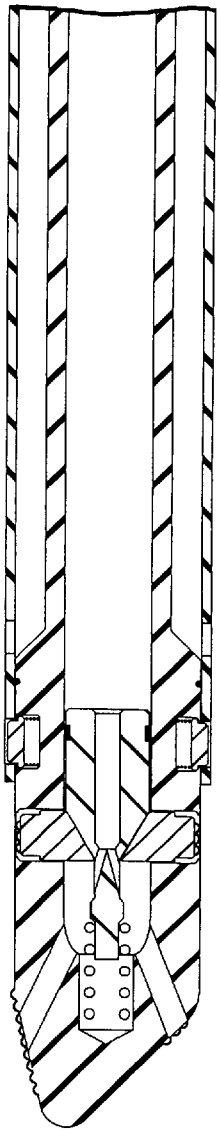
Figure 21:
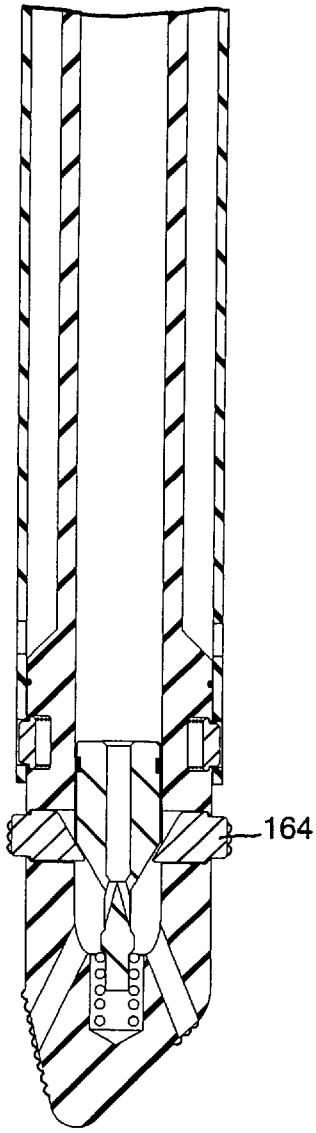

Referring to FIGS. 19 to 21 a more detailed embodiment of a drill arrangement is shown. In FIG. 19 the drill arrangement 160 is provided on the end of a lowering tube 126 (having a central bore 28) and is lowered inside the casing 115 to be installed. Spring biased securing means 163 (FIG. 19) are provided which are activated to extend into corresponding locating openings 165 in the casing. The securing means 163 may be so arranged to automatically engage in the locating means 165 when the correct position is reached. When the drill arrangement 160 is in the desired position at the lower end of the casing drilling elements 164 are extended so that the desired diameter of hole (being necessarily larger than the casing), can be achieved. Engaging means 166 are provided which when activated will urge the drilling elements 164 into the extended position. Spacers 167 center the lowering tube 126.

In this way the casing is installed in the same operation as the hole is formed which provides considerable reductions in the time to create the well as a whole. In order to complete the cementing operation the drilling arrangement 160 may be removed from the end of the casing and retrieved back to surface on the end of the lowering tube 126 and the shoe arrangement as described in relation to FIGS. 10 to 13 can be fitted and lowered into the casing to carry out the cementing and securing operation. Alternatively the drilling arrangement could be adapted to carry out the cementing operation after the desired length of hole has been drilled.

Referring now to FIG. 3 in conjunction with above description a well casing can be constructed with the minimum of annular gap between each length of casing. For example a well casing comprising a number of casing lengths 12, 13, 14, 15, 16 with a first casing section 12 having and outside diameter OD12 of 6.625 inches and an inside diameter ID12 of 6.125 inches being fitted and cemented in position extending downwardly from the top of the well. The second casing section 13 has an outside diameter OD13 of 6 inches and an inside diameter ID13 5.5 inches. The difference D1 between the outside diameter OD13 of the section 13 is less than the internal diameter ID12 of the first section 12 by an amount, which is just sufficient for the second to pass down through the internal, bore of the first section 12. This difference is (in radius 0.125 inches (0.3175 cm) in 0.25 inches (0.635 cm) in the present exemplary embodiment. However it will be appreciated that the invention can be applied to any annular gap size which is required to accommodate the variances in the ovality and other dimensions in the casing sections of the well. It has been found that differences D1, D2, D3, D4, D5 may be as high as 15 mm and a low as 0.1 mm. The actual difference will be as low as possible to maintain the dimensions of the well as a whole as slim as possible.

Each subsequent casing section 14, 15, 16 has an internal diameter ID14 of 5.25 inches, ID15 of 4.625 inches and ID16 of 3.5 inches respectively and an external diameter OD14 of 5.375 inches, OD15 of 4.75 inches and OD16 of 4.125 inches respectively. The differences D2, D3, D4 between the external diameters OD14, OD15, OD16 of each subsequent section 14, 15, 16 and the internal diameters ID13, ID14, ID15 of the previously fitted sections 13, 14, 15 will be just sufficient for the subsequent sections 14, 15, 16 to pass through the internal bores of the previously fitted sections 13, 14, 15.

These differences D1, D2, D3, D4 define the annular gap between respective casing sections 12, 13, 14, 15, 16 and according to the invention need not been so large as to permit the flow of fluids there through during the installation of the sections but need only be large enough to allow the sections to pass freely through each other allowing only for the variations of ovality and wall thicknesses according to the tolerances of manufacture of the sections. When planning and designing the well it is necessary to start with the dimensions of the last casing section since this has to be of a certain minimum size to permit the normal operations to take place at the lowermost point of the well. The required sizes of the other sections are calculated upwardly therefrom and will depend on the expected condition of the rock and location of reservoirs etc. The size of the first section will therefore be eventually calculated and for very deep or long wells will have to have a very large diameter. It is beneficial to reduce this diameter as much as possible. According to the invention this is possible by reducing the annular spaces D1, D2, D3, and D4 between the sections to a minimum.

Thus the differences D1, D2, D3, D4 will determine the ultimate required size of the first section.

These differences D1, D2, D3, D4 between the internal diameters ID12, ID13, ID14, ID15 of the fitted sections 12, 13,14, 15 and the outside diameters OD13, OD14, OD15, OD16 of the sections to be fitted 13, 14, 25 15, 16 may be defined as W (inches or mm) such that the outside diameter ID12 of the first section 12 can be as small as possible and is at most equivalent to:

$$OD12=W\times(n-1)+2\times T\times n+ID16,$$

where T is the average wall thickness of the casing sections 13, 14, 15, 16, ID16 is the internal diameter of the last section and n is the number of casing sections and W is the average diametrical difference.

It has been found that when the casing is made of continuous coiled tubing and my means of the method of the present invention, then W may be less than 15 mm and greater than 0.1 mm depending on the quality of manufacture and length of the section of casing concerned.

It is also preferable and possible in certain circumstances when the well casing is made of continuous coiled tubing that W is less than 10 mm and greater than 0.1 mm. It has also be found that when the well casing is made of continuous coiled tubing and of good quality manufacture with fine tolerance limits on ovality and straightness along its length and if the length of tubing is less than approximately 2000 metres then W may be less than 5 mm and greater than 0.1 mm.

When the well casing is made of joined tubing an additional factor has to be considered and that is the width of the joints between each section. Clearly this will put the greatest limit on the amount to which the value W can be reduced. However it has been determined by the inventor that W may be less than 25 mm and greater than 1 mm and even at the higher end of this range vary useful reductions in the overall diameter of the well and the consequent reductions in material costs and disposal costs as well as well construction time costs can be achieved.

Preferably and also possible by means of the invention is that when the well casing is made of joined tubing W is less than 15 mm and greater than 1 mm.

It has also been found to be possible for certain types of wells depending on the operating demands of the well notably pressure that certain special slimmer joints can be used such that the well casing is made of joined tubing with the value W less than 10 mm and greater than 1 mm by means of the invention.

It will be noted that only the apparatus essential to the understanding of the invention itself is shown and described. The use of other equipment and procedures, which are known in the art, will be necessary and recommended for example, depending on the conditions of the well and its location.

What is claimed is:

1. A method of installing a casing section in a well, comprising the steps of:

lowering a casing section to be installed in a well below an existing casing of a tubular lowering means, at least one connecting means being connected to the casing section, the tubular lowering means extending through the casing section; and providing a flow path including a valve means for selective closing the flow path from an open hole through an annular space between the tubular lowering means and the existing casing, the closable valve means being arranged above the at least one connection means such that flow from the open hole passes the at least one connection means and subsequently passes through the closable valve means.

2. The method according to claim 1, further comprising providing a nonreturn valve which permits pressurized fluids to flow from inside an internal bore of the tubular lowering means to the well outside the section being installed.

3. The method according to claim 2 wherein the nonreturn valve is a lockable nonreturn valve which when in the locked open position permits fluids to flow from the well to the inside of the tubular lowering means and thus back to the surface.

4. The method according to claim 3, further comprising the step of unlocking the nonreturn valve when the casing to be fitted has been lowered to its installed position so that the nonreturn valve operates as a conventional nonreturn valve and preventing unwanted flow of fluids up the internal bore of the tubular lowering means.

5. The method according to claim 4, further comprising dimensioning so that it releases a catch holding the nonreturn valve in an open position.

6. The method according to claim 1, further comprising providing drilling means for the casing section being installed to the hole to be simultaneously drilled or partly drilled while the casing section is being lowered into the well.

7. The method according to claim 6, further comprising providing percussion impact means along the tubular lowering means to impart additional downwards force to the drill and supported by the casing section being lowered and permitting fluid to flow through the annulus.

8. A method of installing a casing section in a well comprising the steps of:

lowering a casing section to be installed into a well by means of first and second connection means arranged on a tubular lowering means, the first connection means being connected to an upper end of the casing section and the second connection means being connected at a lower end of the casing section, with tubular means extending through the casing section; and providing first and second flow paths correspondingly in the first and second connection means to enable fluid from the well to pass through the inside of the casing in the direction of the top of the hole, as the casing is lowered into the well.

9. The method according to claim 8, further comprising providing the first and second flow paths as ports controlled by valves which are held in the open position, during the lowering of the casing.

10. The method according to claim 8, further comprising providing at least one opening through the second connective means connecting the inside of the tubular lowering means to the outside of the casing.

11. The method according to claim 10, further comprising providing a nonreturn valve in an opening which permits pressurized fluids to flow from inside an internal bore of the tubular lowering means to the well outside the section being installed.

12. The method according to claim 11, further comprising providing the nonreturn valve which when in a locked open position permits fluids to flow from the well to the inside of the tubular lowering means and back to the surface.

13. The method according to claim 12, further comprising unlocking the nonreturnvalve when the casing to be fitted has been lowered to its installed position thereby operating the lockable nonreturn valve as a conventional nonreturn valve and preventing the unwanted flow of fluids up the internal bore of the tubular lowering means.

* * * * *